United States Patent [19]

Cassata

[11] Patent Number: 5,016,368

[45] Date of Patent: May 21, 1991

[54] CLOTHING IDENTIFIER

[75] Inventor: Orrin J. Cassata, Schaumburg, Ill.

[73] Assignee: Mr. Tool Manufacturing, Inc., Roselle, Ill.

[21] Appl. No.: 465,754

[22] Filed: Jan. 16, 1990

[51] Int. Cl.[5] ..... G09F 3/10

[52] U.S. Cl. ..... 40/299; 24/108; 40/1.5

[58] Field of Search ..... 40/299, 1.5, 315, 300, 40/301, 663, 668; 24/107, 108, 90 C, 104

[56] References Cited

U.S. PATENT DOCUMENTS

| | | | |
|---|---|---|---|
| 595,286 | 12/1897 | Candel | 24/108 |
| 774,382 | 11/1904 | Engle | 24/108 |
| 1,390,342 | 9/1921 | Delay | 40/301 |
| 2,616,217 | 11/1952 | Wild | 24/104 |
| 4,481,696 | 11/1984 | Kanzaka | 24/108 X |
| 4,654,934 | 4/1987 | Hasegawa | 24/90 C X |
| 4,793,029 | 12/1988 | Burke | 24/90 C X |

FOREIGN PATENT DOCUMENTS

| | | | |
|---|---|---|---|
| 169135 | 10/1921 | United Kingdom | 40/301 |

*Primary Examiner*—Kenneth J. Dorner
*Assistant Examiner*—J. Bonifanti

[57] ABSTRACT

A pair of molded plastic parts, fitted and secured together with an element of the clothing therebetween. The parts including a base having a hole with a circumferential locking surface, and a cover with a locking pin which enters the hole and has a shoulder engaging the locking surface, and non-releasably secures the parts together. Stabilizing pins on the cover engage the clothing element and prevent rotational movement of the cover relative to the clothing.

6 Claims, 1 Drawing Sheet

CLOTHING IDENTIFIER

BRIEF SUMMARY OF THE INVENTION

The invention relates to identifiers, or markers, for identifying obJects, and particularly articles of clothing. The device of the invention consists in a physical article to be applied to the clothing, as distinguished from applying marking material thereto.

OBJECTS OF THE INVENTION

A broad object of the invention is to provide a clothing identifier of very simple form, that is easy to apply to the article to be identified, and is easily observed although being relatively inconspicuous and not distracting.

Another object is to provide such an identifier of the foregoing character that is attractive, and desirable, and possesses the following features and advantages.

1. It consists of separate parts that are rigid and therefore easily manipulatable, and is applied to the clothing by securing the parts together with the clothing therebetween.

2. The device is extremely small, and therefore a supply of them can be easily carried or stored, and easily applied to the articles to be identified without special tools or instruments by merely pushing them together by the fingers.

3. The device is very inexpensive.

DETAILED DESCRIPTION

Figure 1:
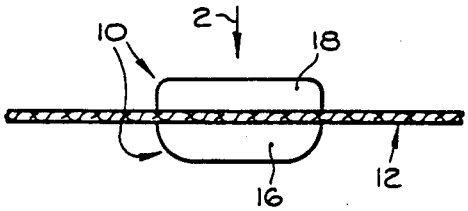
FIG. 1 is a side or edge view of the device applied to an article of clothing to be identified.
Figure 2:
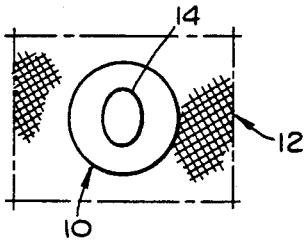
FIG. 2 is a face view from the top of FIG. 1.

The identifier is shown in its entirety in FIG. 1 at 10, applied to an article to be identified, such as an element of clothing 12. FIG. 2 shows the device from the top of FIG. 1, as indicated by the arrow 2 in FIG. 1. An identifying marking is shown at 14.

In accordance with the identifier being adapted to identifying clothing, the article 12 is shown as an element of cloth, or clothing. The device of course may be used for marking various articles, but is particularly adapted to use with such articles in sheet or leaf form, and thus thin, such as a piece of cloth that can be accommodated between the parts of the identifier when they are put together. The manner of applying the device will be described hereinbelow, and the use of clothing or cloth is representative of any article to be identified.

The identifier 10 is made up of two parts 16 and 18. For convenience these parts are referred to as a base 16, and a cover 18, and in most cases they would be positioned in use in such an arrangement, and for that reason they are so referred to, although it is to be understood that the parts may be inverted or used in other positions, and the terms base and cover are not be interpreted as limiting.

Preferably each of the parts 16, 18, is a single integral piece, also preferably a molded plastic piece, although the identifier is not limited to being made of plastic.

Figure 4:
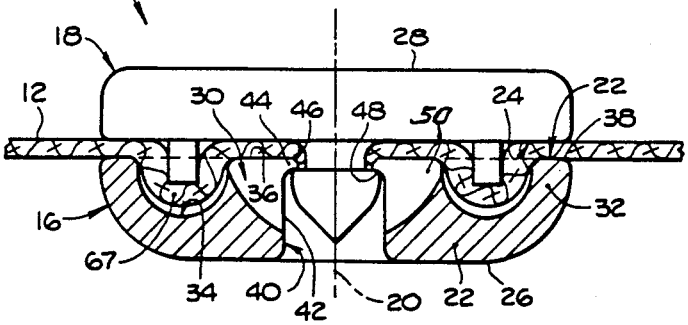
FIG. 4 is a view of the parts secured together with an article to be identified, gripped therebetween, and showing one of the parts in section.
Figure 5:
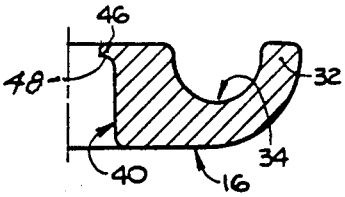
FIG. 5 is a view taken at line 5—5 of FIG. 6, this figure being similar to the right hand portion of FIG. 3, but at position displaced 45° circumferentially from that of FIG. 5.
Figure 6:
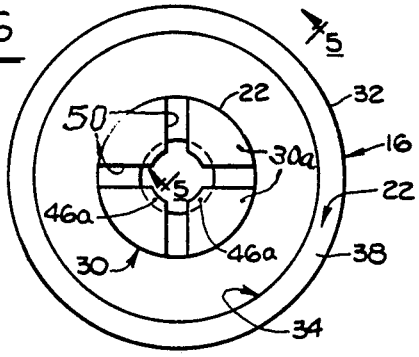
FIG. 6 is a top face view of one of the parts, taken at line 6—6 of FIG. 3.
Figure 7:
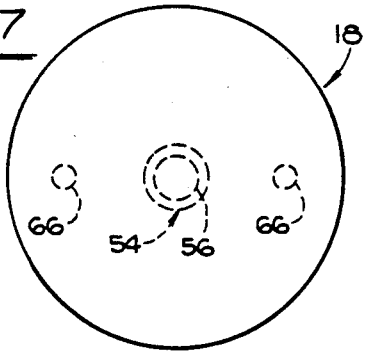
FIG. 7 is a top view of the device oriented according to FIG. 2.

The parts 16, 18, are generally flat, and preferably circular, each having a central axis, the two axes coinciding in a common axis 20 (FIG. 4) when the parts are secured together.

In use in applying the device to an article to be identified, the two parts are secured together as explained hereinbelow, and when so secured together (FIG. 4) the two parts have interfacing surfaces, 22 on the base, and 24 on the cover. The base has a bottom or outer surface 26 opposite its interfacing surface 22, and the cover has a top or outer surface 28, opposite its interfacing surface 24.

The base includes a central boss 30, an outer surrounding rim 32, defining an annular groove 34 therebetween. The boss 30 has a top surface 36, and the rim 32 has a top surface 38, both these top surfaces lying in the interfacing surface 22 of the base. The channel 34 is dual-purpose, assisting in locking the top, and providing flexibility as referred to again hereinbelow. The channel is shown semi-circular in shape in cross section, but it may assume other shapes instead, if desired.

The base has a central axial hole 40 extending therethrough which includes a lower main portion 42. The boss 30 is provided with a lip 44 positioned at the top of the hole 40, adJacent the interfacing surface 22, and directed radially inwardly. This lip surrounds the hole, and it forms and surrounds an upper smaller portion of the hole indicated at 46, the lip forming a downwardly directed locking surface 48 substantially perpendicular to the central axis 20.

The boss is provided with cross slots 50, forming sections **30*a* of the upper portion of the boss. The slots extend through the lip 44, throughout the axial depth of the latter, forming sections 46*a* of the lip, which are separated from each other circumferentially of the hole, but which together form the lip. The provision of the sections 30*a* and 46*a*** provides resilience, relative to that of a continuous element, for locking purposes as referred to below.

The cover 18 includes a body 52, and extending downwardly from the interfacing surface 24 thereof, is a central axial locking pin 54 which includes a relatively reduced dimension shank 56, and an enlarged head 58. The head 58 has a leading, or downwardly extending camming surface 60 which is relatively long, and approaches conical in shape. This surface 60 has a relatively sharp point 61 and leads into a relatively large portion 62 of the head, this portion forming a posterior shoulder 64 substantially perpendicular to the central axis 20 and spaced from the interfacing surface 24.

Also extending from the interfacing surface 24 of the cover are stabilizing pins 66, positioned in register with the channel 34, when the parts are coaxially superposed, and of such length as to enter into the channel when the parts are so superposed.

Figure 3:
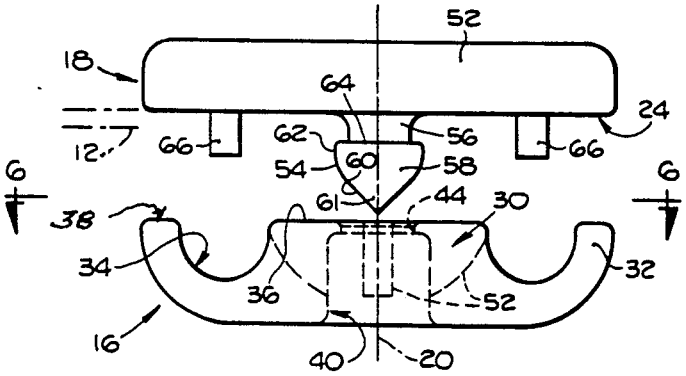
FIG. 3 is a large scale side view of the parts of the device in separated position.

In applying the identifier to the article to be identified, the cover 18 is first applied directly to the clothing 12 (FIG. 3), and the locking pin 54 pushed through the clothing. In this step also, the stabilizing pins 66 may also penetrate through the clothing, especially loose-woven cloth, but not necessarily. Then the parts are pushed together, with the exposed locking pin 54 entering into the hole 40 in the base.

In forcing the parts together, and pushing the head 58 into the hole, the camming surface 60 engages the sections 46*a* of the lip 46 and flexes them, and the entire upper sections 30*a* of the boss 30, radially outwardly. The cross slots 52 provide this flexibility, the sections actually moving or migrating into the channel 34. The sections 46*a* are thus spread apart sufficiently to enable the head to pass into the main part of the hole, past the lip sections. When the parts have been so moved sufficiently, the head 58 is then entirely in the main portion 42 of the hole, and the shoulder 64 engages the locking surface 50, and thereby locks the parts together.

In this last step, the stabilizing pins 66, in those cases where they have penetrated through the cloth, and are exposed, enter into the channel 34. If they have not so penetrated the cloth, they push the corresponding portions 67 of the cloth article 12 into the channel 34. These pins may be of any desired length, but preferably of such length that they actually extend into the channel, and the corresponding portion 67 of the article may touch the bottom of the channel. In either case, whether the pins penetrate through the cloth or not, they retain the top against rotation relative to the cloth, as it may be desired to retain the marking 14 (FIG. 2) in a given position for easy recognition. It is not essential that the base 16 be held against rotation.

It is desired that the plastic utilized in forming the article be relatively hard and rigid. Nevertheless the sections 46*a* of the lip, and sections 30*a* can be flexed radially outwardly sufficiently to enable the head of the pin 54 to enter into the hole. For this purpose the camming surface 60, which is substantially concial, is relatively long and produces a great camming effect The shoulder 64 and the locking surface 50 being both substantially perpendicular to the central axis, thus lie substantially or nearly in a common plane. There is thus virtually no camming effect produced by the shoulder 64 such as would pry or flex the sections 46*a*, 30*a*, outwardly such as would enable the parts to be separated. The device is substantially a one-time use device and normally could not be removed without destruction of at least one of the parts.

The top surface 28 of the cover as indicated above may be planar, and it is continuous, and serves as an effective location for the identifying mark 14 (FIG. 2). In the case of the base 16, the hole 40 may open through the bottom surface, for convenience in molding.

It will be understood that the identifying mark 14 may be applied to the base, if so desired, and it will be further understood that the base may be applied to the article in either of opposite positions, i.e. either of the parts may be positioned on either of the opposite surfaces of the clothing.

In actual practice it has been found that the device may be in the neighborhood of one-half inch in diameter, and in this case also, this dimension is of course not limiting, this small size showing its inconspicuousness

I claim:

1. A clothing identifier, comprising:

a pair of parts separate and normally unconnected from each other, adapted to be secured together with an element of clothing gripped therebetween, the parts consisting of a one-piece base and a one-piece cover, and together constituting the entire identifier, the parts, when so secured together, being in superposed relation and having surfaces that interface, the base having a central hole opening through its said interfacing surface, the hole having a lower main portion of predetermined size, and including a lip directed radially inwardly at a position adjacent its said interfacing surface and distributed circumferentially around the hole and forming and surrounding an upper smaller portion of the hole, and the lip forming a downwardly directly locking surface, the cover including a locking pin projectable into the hole in putting the parts together in superposed position, and positioned in the hole when they are in superposed position, the locking pin including a head that has a leading camming surface operable for flexing the lip in putting the parts together to enable the locking pin to enter the hole and the head having a posterior shoulder engageable with said locking surface for retaining the parts secured together, the base including a central raised boss, the central hole extending upwardly through the boss, the boss having cross slots in its top surface, forming separated sections of the lip and boss, and the material of the base being rigid, and the cross slots rendering said sections flexible in radial direction, and the locking pin being thereby capable of flexing said sections radially outwardly in response to its being projected into the hole.

2. A clothing identifier according to claim 1 wherein, the cover includes stabilizing pins spaced radially from the locking pin projecting from its said interfacing surface engageable with the clothing to prevent rotation of the cover.

3. A clothing identifier according to claim 2 wherein, the base includes an annular groove positioned for receiving the stabilizing pins, and the stabilizing pins are of sufficient length to extend into the groove and force elements of the clothing into the groove in the securement of the parts together, and the stabilizing pins thereby prevent said rotation.

4. A clothing identifier according to claim 2 for use in conjunction with loose-woven cloth, wherein, the stabilizing pins penetrate through the cloth and thereby prevent rotation of the cover relative to the cloth.

5. A clothing identified comprising, a pair of parts that are generally flat and thin, and adapted to be secured together, with an element of clothing gripped therebetween, the parts consisting of a base and a cover, and when so secured together, being in superposed relation and having surfaces that interface, and also having outer surfaces opposite said interfacing surfaces, at least one of the outer surfaces being substantially flat, and the parts together having an axis extending centrally through the parts substantially perpendicular to the flat extension of the parts, the parts being molded pieces, each a single one-piece element, and together constituting the entire identifier, the base including a central axial boss and an outer surrounding rim forming a continuous annular channel therebetween, the boss and rim having extended surfaces lying in said interfacing surface of the base, the base having a central axial hole in said boss opening through said interfacing surface of the base, the hole having a lower main portion of predetermined size, and the base having a lip directed radially inwardly at a position adjacent said interfacing surface of the base and distributed circumferentially around the hole and forming and surrounding an upper smaller portion of the hole, and the lip forming a downwardly directed locking surface, said base having cross slots in its said extended surface cutting through said lip, forming circumferentially separate sections enabling radially outward flexing of the sections, the cover including a central axial locking pin extending from its said interfacing surface projectable into the hole in putting the parts together in superposed position, and positioned in the hole when they are in superposed position, the locking pin including a head that has a leading camming surface substantially conical in shape operable for flexing the lip in putting the parts together to enable the head to enter the hole and a posterior shoulder engageable with said locking surface for retaining the parts secured together, the cover including stabilizing pins extending from its said interfacing surface and positioned radially in register with said channel, and of sufficient length to enter into the channel in response to the parts being put together in superposed relation, and the stabilizing pins being operable in response to the parts being put together to force the clothing at least partially into the channel, and said flat outer surface having an identifying marking thereon.

6. A clothing identifier according to claim 5 wherein, the locking pin has a relatively sharp point at its leading end, and said locking surface and posterior shoulder are of substantial radial dimension and, are positioned substantially perpendicular to said axis.

* * * * *